US007794382B2

(12) United States Patent
Cheich

(10) Patent No.: US 7,794,382 B2
(45) Date of Patent: Sep. 14, 2010

(54) MANUAL DUNNAGE CONVERTING SYSTEM AND METHOD

(75) Inventor: Robert C. Cheich, Independence, OH (US)

(73) Assignee: Ranpak Corp., Concord Township, OH (US)

( * ) Notice: Subject to any disclaimer, the term of this patent is extended or adjusted under 35 U.S.C. 154(b) by 483 days.

(21) Appl. No.: 11/909,332

(22) PCT Filed: Apr. 3, 2006

(86) PCT No.: PCT/US2006/012194

§ 371 (c)(1),
(2), (4) Date: Sep. 21, 2007

(87) PCT Pub. No.: WO2006/107811

PCT Pub. Date: Oct. 12, 2006

(65) Prior Publication Data

US 2010/0029456 A1 Feb. 4, 2010

Related U.S. Application Data

(60) Provisional application No. 60/667,752, filed on Apr. 1, 2005.

(51) Int. Cl.
*B31B 1/02* (2006.01)

(52) U.S. Cl. ..... 493/464; 493/967; 206/409; 206/494

(58) Field of Classification Search ..... 493/464, 493/967, 407, 480; 206/233, 395, 396, 408, 206/409, 494; 53/428, 436, 111 R, 121, 53/122, 523

See application file for complete search history.

(56) References Cited

U.S. PATENT DOCUMENTS 2,806,591 A * 9/1957 Appleton ..... 225/106

(Continued)

FOREIGN PATENT DOCUMENTS

DE 12 45 557 7/1967

(Continued)

OTHER PUBLICATIONS

International Search Report of International Application No. PCT/US2006/012194, published on Oct. 12, 2006 as International Publication No. WO 2006/107811.

*Primary Examiner*—Paul R Durand
(74) *Attorney, Agent, or Firm*—Renner, Otto, Boisselle & Sklar, LLP

(57) ABSTRACT

A motor-free dunnage conversion system for converting a sheet stock material into a relatively less dense dunnage includes a container having a wall with an opening therethrough, a supply of sheet stock material within the container, and a forming member. The forming member has converging sidewalls that define a passage alignable with the opening in the wall. The forming member is a converging chute having a relatively larger inlet spaced from the outlet, which is relatively smaller than the inlet. The forming member functions to crumple the sheet stock material as a packer draws the sheet stock material through the forming member to form a crumpled strip of dunnage. The forming member has a dimension that is larger than a corresponding dimension of the opening to keep the forming member from escaping the container as the packer pulls the stock material through the forming member.

15 Claims, 4 Drawing Sheets

U.S. PATENT DOCUMENTS 3,749,296 A * 7/1973 Harrison ..... 225/106
3,795,355 A * 3/1974 Gerstein ..... 225/106
3,868,052 A * 2/1975 Rockefeller ..... 225/106
3,986,479 A * 10/1976 Bonk ..... 118/506
4,274,573 A * 6/1981 Finkelstein ..... 225/106
4,659,028 A * 4/1987 Wren ..... 242/596.8
5,097,998 A * 3/1992 Shimasaki ..... 225/106
5,131,903 A 7/1992 Levine et al.
5,215,211 A * 6/1993 Eberle ..... 221/1
5,335,811 A * 8/1994 Morand ..... 221/45
6,412,656 B1 7/2002 Placik
6,676,589 B2 1/2004 Kung et al.
6,847,011 B2 * 1/2005 McConnell et al. ..... 219/386
7,025,301 B1 * 4/2006 Notarnicola ..... 242/593
2002/0091053 A1 7/2002 Kung et al.

FOREIGN PATENT DOCUMENTS

WO 2006/047696 5/2006

* cited by examiner

MANUAL DUNNAGE CONVERTING SYSTEM AND METHOD

This invention claims the benefit of International Application No. PCT/US2006/012194, filed Apr. 3, 2006, published in English as International Publication No. WO 2006/107811, which claims the benefit of U.S. Patent Application No. 60/667,752, filed Apr. 1, 2005, both of which are hereby incorporated herein by reference.

FIELD OF THE INVENTION

The present invention relates to an improved dunnage converting system and method for converting sheet stock material into a dunnage product, and more particularly to a manual dunnage converting system and method that does not require a motor.

BACKGROUND

In the process of shipping one or more articles, products or other articles in a container, such as a cardboard box, from one location to another, a packer typically places some type of dunnage material in the shipping container along with the article or articles to be shipped. The dunnage material partially or completely fills the empty space or void around the one or more articles in the container to prevent or minimize any shifting of the articles in the container and/or to provide cushioning for the articles in the container during the shipping process. Some commonly used dunnage materials are plastic foam peanuts, plastic bubble pack, air bags and converted paper dunnage material.

To use storage space more efficiently, a dunnage conversion machine can be used to convert a compact supply of stock material, such as a roll or stack of paper, into a lower density dunnage material as the dunnage material is needed by the packer. These dunnage-on-demand conversion machines typically include one or more motors for driving a conversion assembly and/or a cutting assembly. For example, U.S. Pat. No. 6,676,589 discloses an exemplary dunnage conversion machine that can quickly convert a continuous sheet of paper into a crumpled strip of void-fill dunnage material.

These powered dunnage converters are well suited for high or medium volume applications. They also can be used for low volume applications where a small amount of dunnage is needed from time-to-time, but usually the cost is too high. The powered converters also are somewhat bulky and occasionally require maintenance or repair. Consequently, low volume applications have been serviced by other types of dunnage, such as plastic foam peanuts and manually crumpled newspaper. Plastic foam peanuts are messy and occupy the same volume when being stored as when being used. Crumpled newspaper also is messy and requires the packer to manually crumple the newspaper.

Another apparatus for crumpling and dispensing dunnage is shown in U.S. Pat. No. 5,131,903. This apparatus includes a box-like housing holding a frame. The frame has a pair of inclined side walls for guiding sheet paper from a roll of paper through a reduced dimension corrugated-shaped opening that is generally aligned with an opening in the housing. The opening is in a frame member that forms a transversely extending shelf surrounding the opening. A problem with such an apparatus is that the paper can catch on this shelf as it is pulled through the opening which can potentially cause undesirable tearing of the paper. Another drawback is the relatively large size of the apparatus when compared to the supply of paper contained therein—that is, the apparatus contains a substantial amount of empty space within the box-like housing.

SUMMARY

The present invention provides a dunnage system and method that do not require a motor for converting a sheet stock material into a dunnage product. Instead, the sheet stock material is pulled from a converter by a packer as dunnage is needed. As the stock material is pulled from the converter, it is converted from in essence a two-dimensional sheet into a relatively less dense crumpled three-dimensional dunnage product.

An improved dunnage conversion system includes a container having a forming member that extends to an opening in one wall thereof through which a sheet stock material can be pulled and in the process converted into a crumpled dunnage product.

In particular, the present invention provides a motor-free dunnage conversion system for converting a sheet stock material into a relatively less dense dunnage that includes a container and a forming member at least partially within the container. The container is sized to contain a supply of sheet stock material therein and has a wall with an opening therethrough. The forming member has converging sidewalls that define a passage which terminates in a reduced-width outlet alignable with the opening in the wall of the container. The forming member functions to crumple sheet stock material as it is drawn therethrough to form a crumpled strip of dunnage. In other words, the forming member is a converging chute having a relatively larger inlet spaced from the outlet, which is relatively smaller than the inlet. The forming member has a dimension that is larger than a corresponding dimension of the opening to keep the forming member from escaping the container as stock material is drawn through the forming member.

The system may include a supply of sheet stock material within the container, with the forming member interposed between the supply and the opening. The supply may include a fan-folded stack of sheet stock material or a roll of sheet stock material having a longitudinal axis aligned with the opening. An exemplary supply of sheet stock material includes one or more plies of kraft paper.

The present invention also provides another motor-free dunnage conversion system with a container sized to receive a supply of sheet stock material within the container. The container has an outlet through which sheet stock material can be drawn to form a relatively less dense strip of dunnage. The outlet is movable between a shipping position and a converting position removed from the shipping position.

According to one embodiment of the invention, the container has multiple accordion-folded pleats in side walls thereof that allow the volume of the container to be expanded. According to another embodiment of the invention, the container has an outer portion and an inner portion telescopically movable relative to one another for movement between a compact shipping configuration and an extended converting configuration.

The present invention also provides a method of converting sheet stock material into a relatively less dense dunnage product, comprising the steps of reconfiguring a container from a shipping configuration to a converting configuration, and when the container is in the converting configuration manually pulling the sheet stock material from a supply of sheet stock material in the container and through an outlet in the container whereby the stock material is crumpled and permanently deformed to form a relatively less dense strip of dunnage. The pulling step may include causing a forming member having a relatively large inlet spaced from the relatively smaller outlet to float within the container as the stock material is pulled therethrough.

The foregoing and other features of the invention are shown in the drawings and particularly pointed out in the claims. The following description and annexed drawings set forth in detail one or more illustrative embodiments of the invention; this being indicative, however, of but one or a few of the various ways in which the principles of the invention might be employed.

DETAILED DESCRIPTION

The present invention provides a motor-free dunnage conversion system for manually converting a sheet stock material into a relatively less dense, crumpled strip of dunnage. The system includes a container or other housing with a compact shipping configuration. One wall of the container has an opening through which the sheet stock material is pulled by a packer. In the process, the stock material is inwardly gathered and randomly crumpled to form a crumpled strip of dunnage. The system provides a convenient way to convert sheet stock material into a relatively lower density dunnage product as it is pulled from the container.

One feature of the system provided in accordance with the present invention is that the container is reconfigurable from a compact shipping configuration to a converting configuration. For efficient shipping and storage, the amount of empty space in the container is preferably minimized. In the converting configuration, however, increasing the distance between the opening in the wall and the stock material improves the process of shaping and crumpling the stock material to form a dunnage product.

Figure 1:
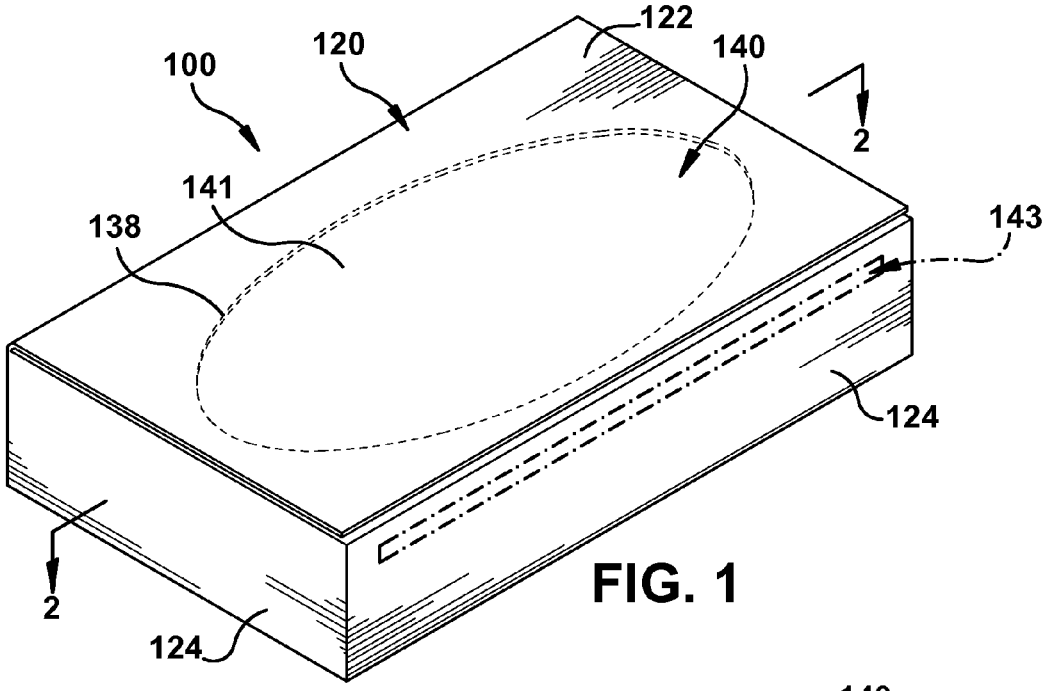
FIG. 1 is a perspective view of a dunnage system provided in accordance with the present invention in a shipping configuration.
Figure 2:
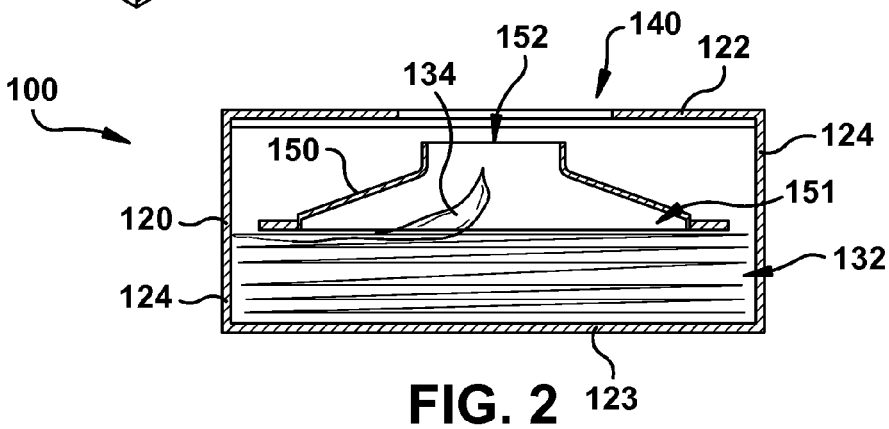
FIG. 2 is a cross-sectional view of the dunnage system as shown along line 2-2 of FIG. 1 in a converting configuration.
Figure 3:
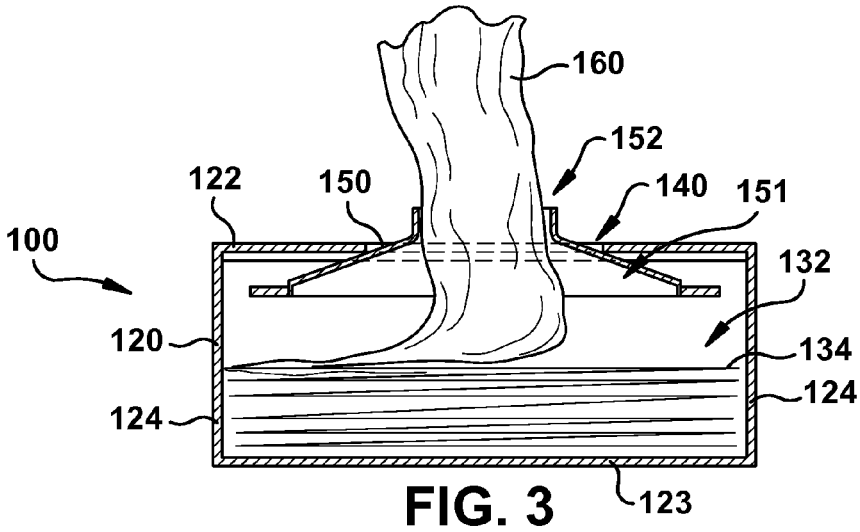
FIG. 3 is a cross-sectional view of the dunnage system of FIG. 2 with dunnage being dispensed therefrom.

Referring to the drawings, and initially to FIGS. 1-3, an exemplary dunnage conversion system 100 includes a container 120, which typically has a generally rectangular shape. The container 120 may be made of any suitable material, preferably one that is disposable or recyclable, such as one or more of cardboard, corrugated or solid fiberboard, paperboard, plastic, or even metal, although cardboard is typical. The illustrated container 120 has a top wall 122, a bottom wall 123 spaced from the top wall 122, and four upright side walls 124 (two shown) extending therebetween. The container 120 could include more or fewer walls of various orientations for storing and transporting the supply of stock material.

The container 120 is sized to contain a supply 132 of sheet stock material 134 therein. The supply 132 includes one or more plies of sheet stock material 134, such as paper, and more particularly kraft paper. The stock material 134 can be provided in the form of a fan-folded stack, as shown, in the form of a roll or in the form of a stack of discrete sheets. If discrete sheets are used, the discrete sheets preferably are interleaved and of sufficient length such that pulling a leading sheet off the stack will draw a trailing sheet with it, one after the other. If one or more stock rolls are used, the stock roll or rolls can be supported in the container by suitable means for rotation so that the stock material can be paid off from the outside of the roll. In an alternative arrangement, the stock roll or rolls can be supported on one or more outer portions of the roll so that stock material can be withdrawn from the center or inside of the roll. Regardless of the type of stock material, preferably the stock material is perforated or otherwise weakened along longitudinally-spaced, transversely-extending tear lines to enable and/or facilitate separating discrete sections of dunnage from the crumpled strip.

As mentioned above, one wall of the container 120 has an opening 140 therethrough through which the sheet stock material 134 can be withdrawn from the supply 132, the top wall 122 in this embodiment. The opening 140 typically has a width that is less than the width of the container 120 and less than the width of the stock material 134. The opening 140 generally has a rounded shape and typically is circular or elliptical, although it is not limited to a rounded shape.

In the shipping configuration shown in FIG. 1, the opening 140 is closed by a cutout or knockout portion in the top wall 122 of the container 120 that defines a cover 141. The opening 140 is delineated by a cut line whereby a user can cut along the cut line and form or expose the opening. Alternatively, the opening 140 can be originally provided, and optionally covered by a protective sheet that may be removed to expose the opening 140. Still another alternative is shown in the illustrated embodiment. A score line or series of perforations 138 form a frangible connection between the cover 141 and the balance of the top wall 122. The perforations 138 facilitate removal of the cover 141 to put the container in its converting configuration. In the converting configuration, stock material 134 can be drawn from the supply 132 for conversion into crumpled dunnage.

The container 120 can also have a slot 143 (shown in phantom) that is substantially the same width as the sheet stock material 134, to allow stock material 134 to be withdrawn from the supply 132 without crumpling. The slot 143 or other opening normally is provided above the height of supply 132 of stock material in the container 120. Relatively uncrumpled stock material drawn through the slot 143 can be useful in wrapping an article for packaging or providing a cover layer or a base layer in a packing container in which an article is to be packed.

The dunnage system 100 also includes a forming member 150 having a passage therethrough that guides and shapes the stock material in a converging manner to inwardly gather and randomly crumple the stock material 134 as it is drawn therethrough and out the opening 140 in the container 120. The illustrated forming member 150 has converging sidewalls that define a relatively large inlet 151 and terminate in a reduced-width outlet 152. The converging sidewalls thus define a passage having a smaller outlet 152 than inlet 151. The converging sidewalls also provide a smooth transition from the inlet 151 all the way to the outlet 152. The forming member 150 functions as a funnel or converging chute and generally provides a gradual transition from the relatively wider volume inside the container 120 to the relatively smaller outlet opening 152 without a shelf or other interruption upon which the stock material 134 can catch.

The forming member 150 typically is formed of plastic, although other materials could be used. Metal, for example, may be used to edge at least a portion of the outlet 152 to facilitate separating discrete dunnage products from the crumpled strip. The outlet 152 of the forming member 150 (or the slot 143) can include a sharp edge for cutting the stock material, or a serrated edge or a notch for catching and either tearing the stock material or for holding the stock material so that the packer can tear a section of dunnage from the crumpled strip at a tear line in the stock material. Those skilled in the art will also appreciate that other forming members could be used in addition to or in the place of the illustrated forming member.

With the container 120 in its shipping configuration, the forming member 150 fits within the container 120 interposed between a wall of the container 120, in this case the top wall 122, and the supply of stock material 132. Because the container 120 typically is substantially rectangular, multiple containers can be stacked one atop the other and closely adjacent one another. The shipping configuration is thus very compact and relatively easy to store and transport.

With the opening 140 cleared of its cover 141 to place the container 120 in its converting configuration, the stock material 134 is accessible by a packer. The packer can reach into the container through the outlet 152 in the forming member 150 and pull the leading edge of the stock material 134 through the forming member 150 (or bypass the forming member 150 to pull the stock material through the slot 143 without crumpling).

The forming member 150 is not secured to the container 120, and as the stock material 134 is pulled therethrough, friction between the forming member 150 and the stock material will cause the packer to pull the forming member 150 toward and through the opening 140 in the container 120. As the packer pulls on the stock material 134, the forming member 150 can project beyond the opening 140 in the container 120. The forming member 150 has a dimension that is greater than a corresponding dimension of the opening 140, however, and the top wall 122 in which the opening 140 is formed is secured in place, typically with an adhesive, although other means may be used. As a result, the forming member 150 is captured within the container 120 and is not pulled completely through the opening 140 with the stock material 134 or otherwise easily removed from the container 120.

When a desired amount of dunnage has been pulled from the container 120, the packer can tear, cut or otherwise separate a section of the crumpled strip 160 for use in packing one or more articles in a shipping carton or the like. When the packer stops pulling stock material 134 through the forming member 150, the forming member 150 may settle back toward the supply 132 until the packer pulls on the stock material 134 again.

Allowing the forming member 150 to move in this fashion when the container 120 is in the converting configuration increases the distance between the forming member 150 and the supply 132 of stock material 134. The additional distance is believed to facilitate the conversion process. In particular, this additional distance facilitates shaping and inwardly randomly crumpling the stock material 134 as it is pulled through the forming member 150, while reducing the likelihood of the stock material tearing prematurely.

Figure 4:
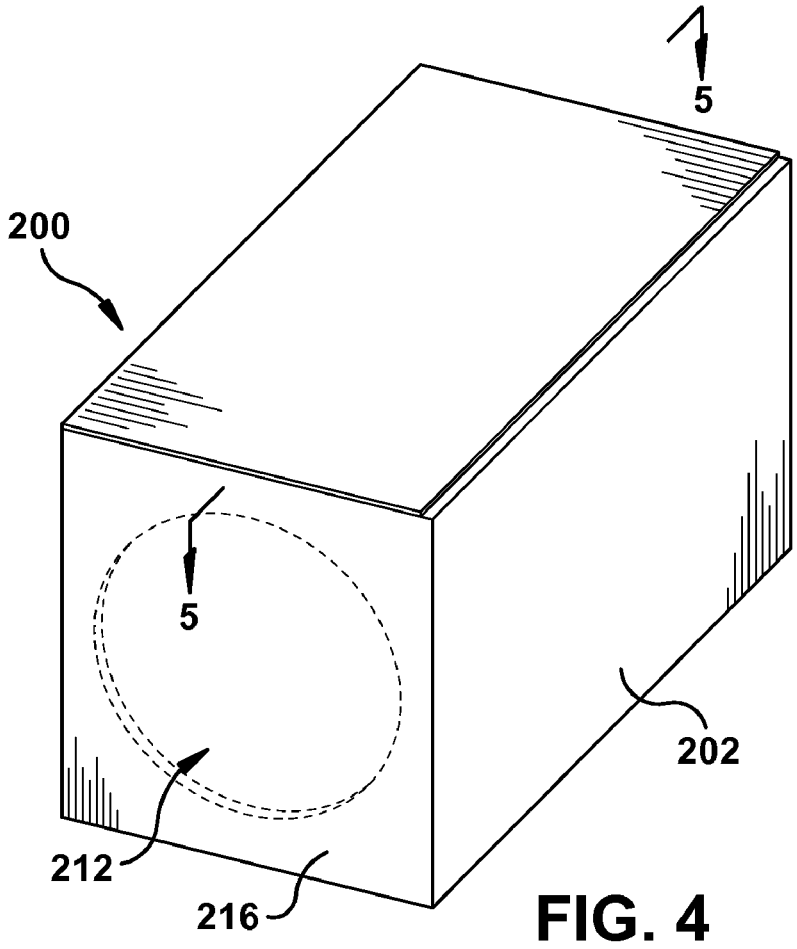
FIG. 4 is a perspective view of another dunnage system provided in accordance with the present invention in a shipping configuration.
Figure 5:
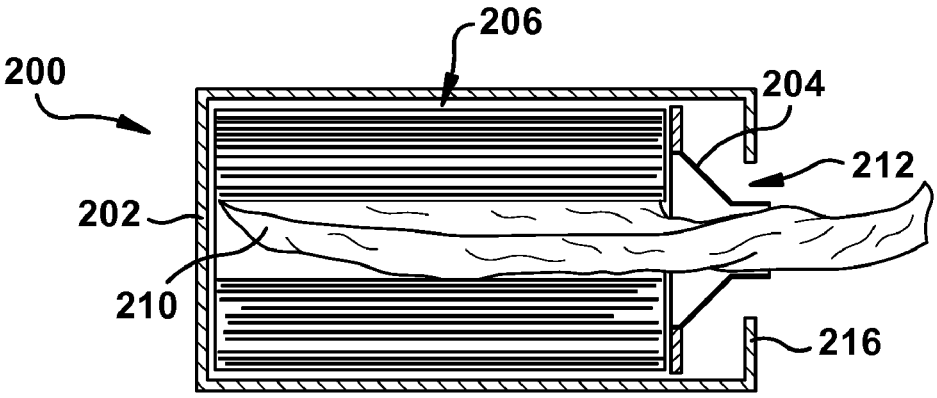
FIG. 5 is a cross-sectional view of the dunnage system as shown along line 5-5 of FIG. 4 in a converting configuration with dunnage being dispensed therefrom.

A variation provided by the present invention is shown in FIGS. 4 and 5. In these figures, another dunnage conversion system 200 includes a container 202 having a forming member 204 and a supply 206 of sheet stock material 210. The forming member 204 is substantially the same as the forming member 150 shown in FIGS. 2 and 3. The sheet stock material 210 in this embodiment is in the form of roll, however, rather than the fan-folded stack shown in FIGS. 2 and 3. The sheet stock material 210 is drawn from the center of the roll, through the passage in the forming member 204, and out an opening 212 in an end wall 216 of the container 202. Drawing stock material from the center of a roll rather than from the outside of the roll means that no provision has to be made for movement of the roll during the conversion process.

Providing the forming member 204 within the container 202 provides a complete, self-contained conversion system 200 that is readily stored and transported. If recyclable materials are used, the entire dunnage system is readily recyclable as well. A cardboard container, recyclable plastic forming member and recyclable stock material combine to provide an environmentally responsible packaging system.

The present invention also provides other types of dunnage conversion systems that have a compact shipping configuration and a conversion configuration where a forming member is spaced from the supply of stock material, such as by providing an expandable container.

Figure 6:
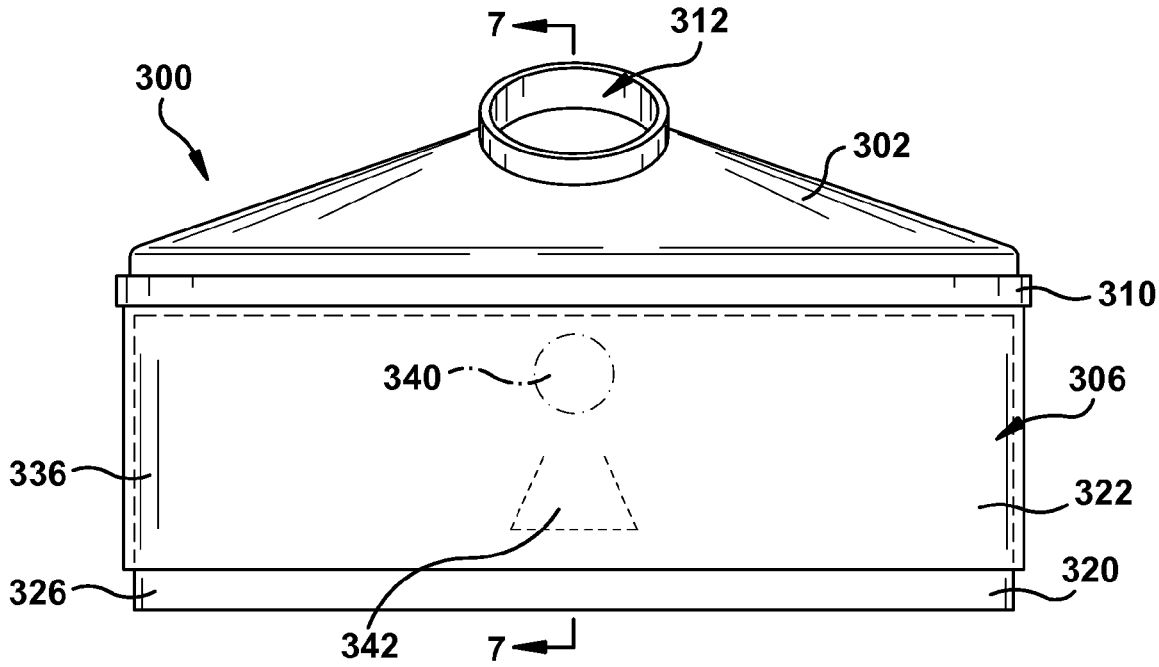
FIG. 6 is a front elevation view of another dunnage system provided in accordance with the present invention in a shipping configuration.
Figure 7:
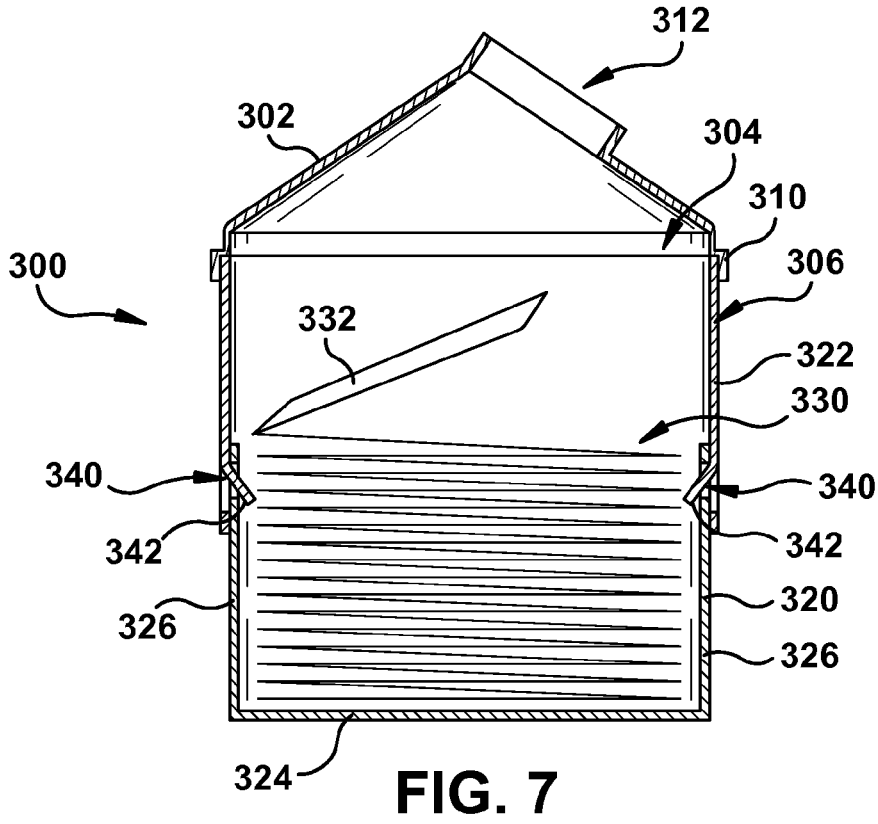
FIG. 7 is a cross-sectional view of the dunnage system as shown along line 7-7 of FIG. 6 in a shipping configuration.

In FIGS. 6 and 7, a dunnage conversion system 300 has a forming member 302 that is attached over an open side 304 of a container 306, such as a top side. The container 306 in this case does not need a top wall. The container 306 is telescopically expandable, as explained below.

Turning to the illustrated forming member 302 first, however, the forming member 302 has a flange 310 that extends from the wider end of a funnel portion and outward, over the sides of the container 306. The flange 310 facilitates attachment to the container and can help to hold the forming member 302 in place relative to the container, such as barbs or teeth formed in the flange, adhesive, or other fasteners. The forming member 302 can be removed and re-used with another container containing a new supply of stock material. This arrangement makes replacing the supply of stock material a simple matter, generally requiring only minor assembly such as mounting the forming member and/or repositioning the top wall of the container. The forming member 302 provides a smooth transition to its outlet 312 from the extents of the container 306.

The container 306 in this system 300 has a lower portion 320 and an upper portion 322 telescopically movable relative to one another. The lower portion 320 is defined by a bottom wall 324 and one or more side walls 326 extending about the perimeter of the bottom wall 324, typically perpendicular to the bottom wall 324. The lower portion 320 of the container 306 is sized to receive a supply 330 of sheet stock material 332 in the form of a fan-folded stack of paper, for example. The lower portion 320 also may provide space for a forming member within the container 306, as described in the previous embodiments.

The upper portion 322 of the container 306 is defined by one or more side walls 336 that correspond to respective side walls 326 of the lower portion 320 of the container 306. The side walls 326 and 336 of the lower and upper portions 320 and 322, respectively, are substantially parallel to one another. The upper portion 322 of the container 306 also may include a top wall, as in the embodiment shown in FIG. 1, although a top wall is not needed when the illustrated forming member 302 is used.

The container 306 further includes a mechanism for holding the lower and upper portions 320 and 322 in at least an extended converting configuration as shown in FIG. 7. In the illustrated embodiment, the holding mechanism is formed by cooperating tabs and slots in the lower and upper portions of the container 306. Opposing side walls 326 of the lower portion 320 have openings 340 therein. Corresponding opposing side walls 336 of the upper portion 322 have tabs 342 formed therein that can be pushed inward and through the openings 340 in the side walls 326 of the lower portion. Each tab 342 is defined by cut lines, score line or series of perforations 344 along which a portion of the tab 342 can be separated from the side walls 336. A hinge portion 346 retains a connection between the tab 342 and the side wall 336. A portion of the tab 342 has a dimension that is greater than a corresponding dimension of the opening 340. Consequently, once the tab 342 is pushed through the opening 340, the tab resists being pulled back through the opening 340, thereby holding the container 306 in the desired position. This kind of holding mechanism is provided as an example and other kinds of mechanisms for holding the lower and upper portions in the converting and/or shipping configuration are known to the person of ordinary skill in the art.

The stock material 332 thus can be pulled from the supply 330 and through the forming member 302 to provide a crumpled dunnage product. The telescoping nature of the container 306 allows the forming member 302 to be spaced from the supply 330 of stock material 332 in the converting configuration to enhance the conversion process, while also providing a more compact shipping configuration that occupies a smaller volume.

Figure 8:
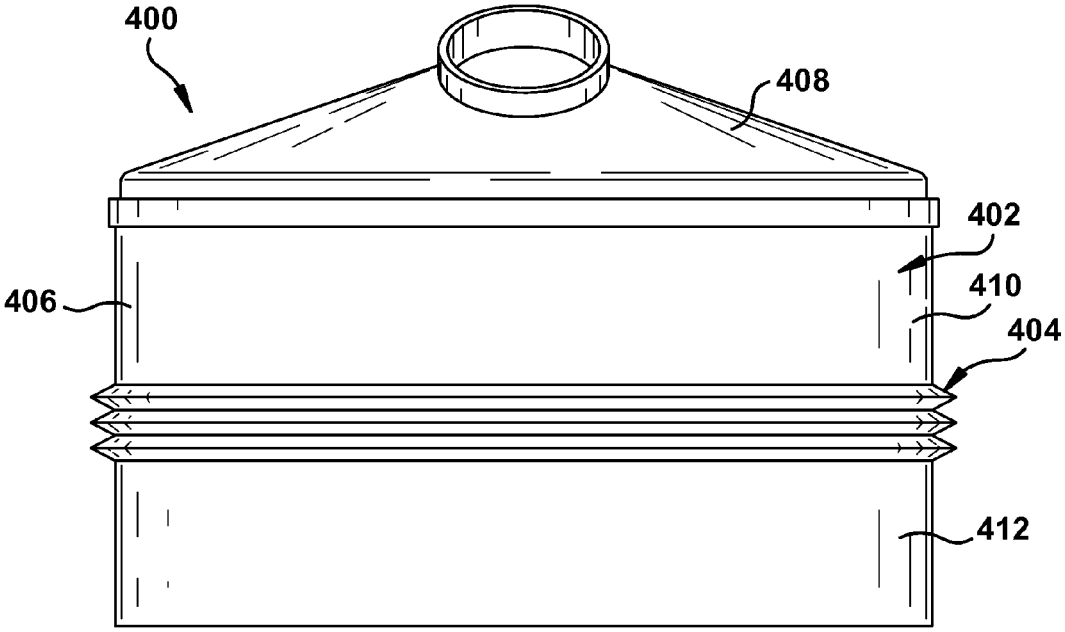
FIG. 8 is a front elevation view of another dunnage system provided in accordance with the present invention in a shipping configuration.
Figure 9:
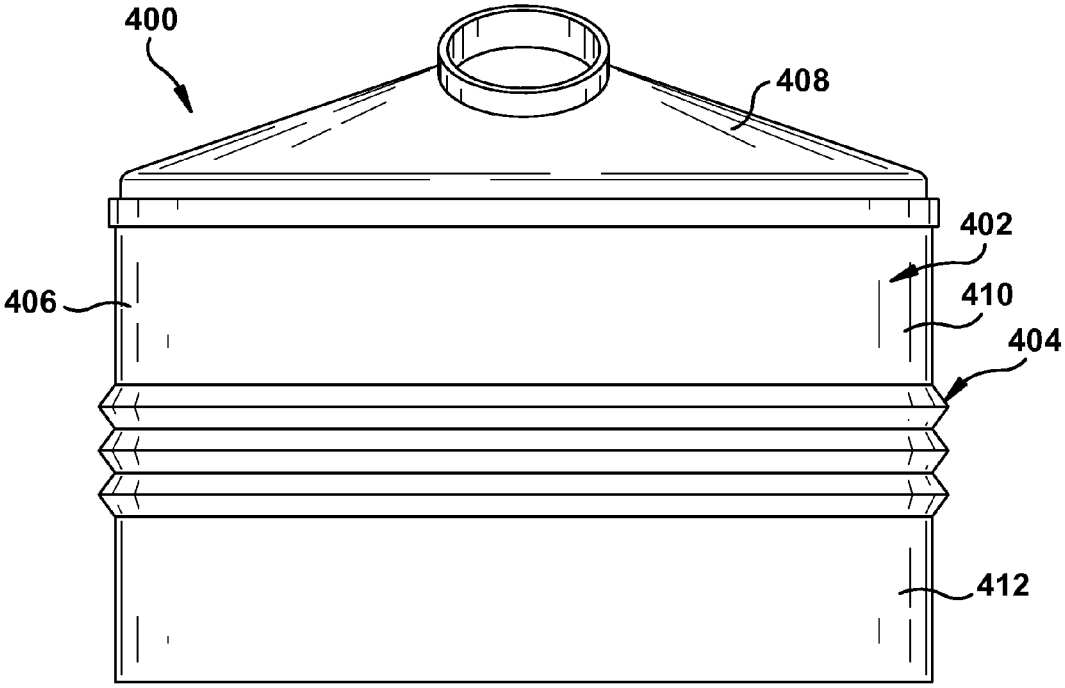
FIG. 9 is a front elevation view of the dunnage system of FIG. 8 in a converting configuration.

Similarly, FIGS. 8 and 9 show another dunnage conversion system 400 provided by the present invention. The dunnage conversion system 400 is substantially similar to the dunnage conversion system 300, except that instead of a telescopic container, the container 402 includes a series of pleats 404 in the side walls 406 that expand in the nature of an accordion. The system 400 includes a forming member 408 and a supply of stock material (not shown) that are substantially the same as those previously described. Simply pulling up on an upper portion 410 of the container 402 relative to a lower portion 412 of the container 402 should be sufficient to expand the pleats 404 and move the container 402 from a relatively compact shipping configuration (FIG. 8) to an expanded converting configuration (FIG. 9). Although only a few pleats are shown in the drawings, more or fewer pleats may be provided. In its more compact shipping configuration, the container 402 is sufficiently sized to receive a supply of sheet stock material, while providing an increased distance between the supply and the forming member 408 when the container 402 is in its expanded converting configuration.

In summary, the present invention provides a motor-free dunnage system that does not require a motor to feed the stock material, to affect the shape of the crumpled strip of dunnage or to sever discrete dunnage products from the crumpled strip. A motor requires a source of power, fuel or electricity, for example, and such power sources might not be conveniently available at the location where the converter is being used. Moreover, without a motor, the converter generally will be lighter weight and more compact. The lighter weight in turn makes the converter more portable and easier to store and move to different locations. Finally, the very simplicity of the converter and its lack of many moving parts generally makes it easier and less expensive to build, maintain and operate.

Although the invention has been shown and described with respect to certain preferred embodiments, equivalent alterations and modifications will occur to others skilled in the art upon reading and understanding this specification and the annexed drawings. In particular regard to the various functions performed by the above described integers (components, assemblies, devices, compositions, etc.), the terms (including a reference to a "means") used to describe such integers are intended to correspond, unless otherwise indicated, to any integer which performs the specified function of the described integer (i.e., that is functionally equivalent), even though not structurally equivalent to the disclosed structure which performs the function in the herein illustrated exemplary embodiment or embodiments of the invention. In addition, while a particular feature of the invention might have been described above with respect to only one of several illustrated embodiments, such feature can be combined with one or more other features of the other embodiments, as can be desired and advantageous for any given or particular application.

What is claimed:

1. A method of converting sheet stock material to a relatively less dense dunnage product, comprising the steps of reconfiguring a container from a shipping configuration to a converting configuration, and when the container is in the converting configuration manually pulling the sheet stock material from a supply of sheet stock material in the container and through an outlet in a forming member captured in the container whereby the stock material is crumpled and permanently deformed to form a relatively less dense strip of dunnage, wherein the pulling step includes causing the forming member, which has a relatively large inlet spaced from the relatively smaller outlet, to float within the container as the stock material is pulled therethrough.

2. A method of converting sheet stock material to a relatively less dense dunnage product, comprising the steps of reconfiguring a container from a shipping configuration to a converting configuration, and when the container is in the converting configuration manually pulling the sheet stock material from a supply of sheet stock material in the container and through an outlet in a forming member captured in the container whereby the stock material is crumpled and permanently deformed to form a relatively less dense strip of dunnage wherein the reconfiguring step includes moving the outlet from a shipping position to a converting position removed from the shipping position.

3. A motor-free dunnage conversion system for converting a sheet stock material into a relatively less dense dunnage, comprising a container sized to contain a supply of sheet stock material therein, the container having a wall with an opening therethrough, and a forming member at least partially within the container, the forming member having converging sidewalls that define a passage which terminates in a reduced-width outlet alignable with the opening in the wall, the forming member having a relatively larger inlet that is spaced from the relatively larger outlet, wherein the outlet of the forming member is smaller than the opening in the wall; and the wall with the opening is movable between a shipping position and a converting position removed from the shipping position, the forming member functioning to crumple sheet stock material as it is drawn therethrough to form a crumpled strip of dunnage.

4. A system as set forth in claim 3, wherein the forming member is a converging chute having a relatively larger inlet spaced from the outlet, which is relatively smaller than the inlet.

5. A system as set forth in claim 3, including a supply of sheet stock material within the container, the forming member being interposed between the supply and the opening.

6. A system as set forth in claim 5, wherein the supply includes a fan-folded stack of sheet stock material.

7. A system as set forth in claim 5, wherein the supply includes a roll of sheet stock material having a longitudinal axis aligned with the opening.

8. A system as set forth in claim 5, wherein the supply of sheet stock material includes one or more plies of kraft paper.

9. A system as set forth in claim 3, wherein the forming member has a dimension that is larger than a corresponding dimension of the opening to keep the forming member from escaping the container as stock material is drawn through the forming member.

10. A system as set forth in claim 3, wherein the container has a shipping configuration in which the opening in the wall of the container is covered by a removable cover, and a converting configuration in which the cover is removed from the opening.

11. A system as set forth in claim 3, wherein the container has multiple accordion-folded pleats in side walls thereof that allow the volume of the container to be expanded.

12. A system as set forth in claim 3, wherein the container has an outer portion and an inner portion telescopically movable relative to one another for movement between a compact shipping configuration and an extended converting configuration.

13. A system as set forth in claim 3, wherein the container has a mechanism that can be used to limit the extent to which the outlet can move from the converting position as sheet stock material is pulled through the outlet.

14. A system as set forth in claim 13, wherein the securing mechanism includes a tab in the outer portion and a cooperating opening in the inner portion, the tab having a portion that is wider than the opening in the inner portion such that after passing through the opening it catches and restricts further movement of the outer portion relative to the inner portion.

15. A system as set forth in claim 3, wherein the forming member is removably attached to an open side of the container.

* * * * *